United States Patent [19]

Paton et al.

[11] 3,990,499

[45] Nov. 9, 1976

[54] APPARATUS FOR MAKING INGOTS BY ELECTROSLAG REMELTING

[76] Inventors: Boris Evgenievich Paton, ulitsa Kotsjubihskogo, 9, kv. 21; Boris Izrailevich Medovar, bulvar Lesi Ukrainki, 2, kv. 8; Jury Vadimovich Latash, Vazdukhoflotsky prospekt, 81, kv. 14; Leonty Vasilievich Chekotilo, ulitsa Scherbakova, 49-a, kv. 10; Vitaly Mikhailovich Baglai, ulitsa Semashko, 10, kv. 54/3; Viktor Leonidovich Artamonov, ulitsa Sovetskaya, 9, kv. 4; Rodimir Ivanovich Garkaljuk, Ultisa Bolshaya Kitaevskaya, 142, korpus 142, kv. 33; Viktor Anatolievich Timchenko, ulitsa Vladimirskaya, 98/3, kv. 36; Evgeny Fedorovich Malichenko, prospekt Ertuziastov, 7/2, kv. 161, prospekt Entuziastov, 7/2, kv. 161; Leonid Mikhailovich Stupak, Brestlitovsky prospekt, 39, kv. 9; Rudolf Solomonovich Dubinsky, Brestlitovsky prospekt, 4, kv. 15, all of Kiev, U.S.S.R.

[22] Filed: Mar. 16, 1973

[21] Appl. No.: 341,938

Related U.S. Application Data

[62] Division of Ser. No. 124,836, March 16, 1971, abandoned, which is a division of Ser. No. 771,165, Oct. 28, 1965, abandoned.

[52] U.S. Cl. ..... 164/252; 164/273 R; 164/283 M; 164/DIG. 6

[51] Int. Cl.[2] ..... B22D 7/04

[58] Field of Search ..... 164/252, 85, 250, 48, 164/50, 52, 49, 273 R, 283 R, 283 M, DIG. 6

[56] References Cited

UNITED STATES PATENTS

| | | | |
|---|---|---|---|
| 2,369,233 | 2/1945 | Hopkins | 164/252 |
| 2,405,254 | 8/1946 | Hopkins | 164/252 UX |
| 2,937,422 | 5/1960 | Bohme | 164/252 X |
| 3,268,958 | 8/1966 | Sickbert | 164/258 X |
| 3,589,434 | 6/1971 | Kleinhagauer et al. | 164/252 |
| 3,610,320 | 10/1971 | Medovar et al. | 164/252 |
| 3,650,311 | 3/1972 | Fritsche | 164/52 |
| 3,687,188 | 8/1972 | Paton et al. | 164/52 |
| 3,709,283 | 1/1973 | Paton et al. | 164/50 |

FOREIGN PATENTS OR APPLICATIONS

| | | | |
|---|---|---|---|
| 1,252,218 | 10/1967 | Germany | 164/252 |
| 1,200,278 | 7/1970 | United Kingdom | 164/252 |
| 1,103,350 | 2/1968 | United Kingdom | 164/252 |

*Primary Examiner*—Ronald J. Shore

*Attorney, Agent, or Firm*—Strauch, Nolan, Neale, Nies & Kurz

[57] ABSTRACT

Apparatus for electroslag remelting of at least one consumable electrode in a cooled mold assembly with a cooled bottom plate having mechanism accomplishing relative movement between at least a part of the mold assembly and the ingot being formed during forming of the ingot. Movement of selective parts of the mold assembly relative to the ingot and/or the electrode is provided with or without movement of the electrode itself. Structure for bottom pouring of molten slag is provided. A specific mold assembly has, as an element, a cooled core device enabling making hollow ingots, in which case the hollow core device can be moved axially, reciprocated axially and reciprocally rotated during forming of the ingot. Electrical power for the electroslag remelting can be connected between the consumable electrode and any or all elements of the mold assembly.

11 Claims, 3 Drawing Figures

APPARATUS FOR MAKING INGOTS BY ELECTROSLAG REMELTING

CROSS REFERENCE TO RELATED APPLICATION

This application is a division of application Ser. No. 124,836 filed Mar. 16, 1971, now abandoned, which is a division of application Ser. No. 771,165, filed Oct. 28, 1968, now abandoned.

BACKGROUND OF THE INVENTION

The present invention relates to methods for obtaining metal hollow ingots by electroslag remelting, and to devices for effecting same. The invention may be made use of for obtaining hollow ingots of pipe stock from steels, alloys and metals (ball-bearing, highly alloyed, heat-resistant, anticorrosive, high-strength structural, and the like including those difficult to work), intended for subsequently processing into pipes and other articles by pressing, rolling out, rolling, etc.

Known in the prior art is a method for obtaining hollow metal ingots by the electroslag remelting of a hollow (in the tubular form) consumable electrode in a cooled annular ingot mold composed of a cooled mold and a cooled bottom plate together with a cooled core being made stationary in relation therewith.

In this case, a consumable electrode is remelted in an annular gap between the mold and core. During the entire remelting process of a hollow ingot, the slag bath is given an annular form. Its cross section is almost equal to that of a hollow ingot to be made.

A disadvantage of the prior-art method consists first of all in that for making ingots there are employed expensive hollow (in the tubular form) consumable electrodes. Moreover, the hollow ingot to be built-up squeezes the core during shrinkage, which may cause cracking in the ingot, and as a result the core will have to be removed from each ingot by mechanical means.

A primary object of the present invention is to provide such apparatus using electroslag remelting to make ingots, particularly hollow ingots, which would permit using cheap consumable electrodes of a solid section (both deformed or cast), precluding the formation of cracks in the ingot, making ingots, particularly hollow ingots possessing a good internal surface, to be directly used for further processing.

In conformity with these and other objects of the invention, the proposed device or apparatus for making metal hollow ingots by the electroslag remelting of a consumable electrode in a cooled mold having a core disposed therein, the core forming the internal cavity of the ingot being built up on a cooled bottom plate, features, according to the invention, a mold, a core and a bottom plate together with an ingot secured thereon in the process of remelting the consumable electrode, which are given longitudinal motion in relation to each other so that the upper end face of the core is constantly immersed in the molten slag bath.

The mutual motion of the mold, core and bottom plate may be carried into effect either by moving the cooled core upwardly in relation to the stationary mold and bottom plate, or by moving the bottom plate together with the ingot secured thereon downwardly in relation to the core and stationary mold, or, finally, by moving the mold together with the bottom plate and the ingot secured thereon and being built-up downwardly in relation to the core.

To improve the internal surface of the hollow ingot being made, the core during the remelting process should be given rocking motion.

The device for carrying into effect the proposed method, comprising a cooled mold, a bottom plate and a core for shaping a cavity in the ingot being built-up, according to the invention, is provided with mechanisms for effecting mutual motion of the mold, bottom plate and core in the process of remelting a consumable electrode.

The device is preferably provided with a mechanism for imparting to the cooled core a rocking reciprocating motion in a longitudinal direction, and a mechanism for imparting to the core reciprocal rotary motion.

The nature of the present invention will further be made more fully apparent from a consideration of the following description of its exemplary embodiments, taken in conjunction with the accompanying drawings.

BRIEF DESCRIPTION OF DRAWINGS

Preferred structural embodiments of this invention are disclosed in the accompanying drawings in which.

Figures 1, 2:
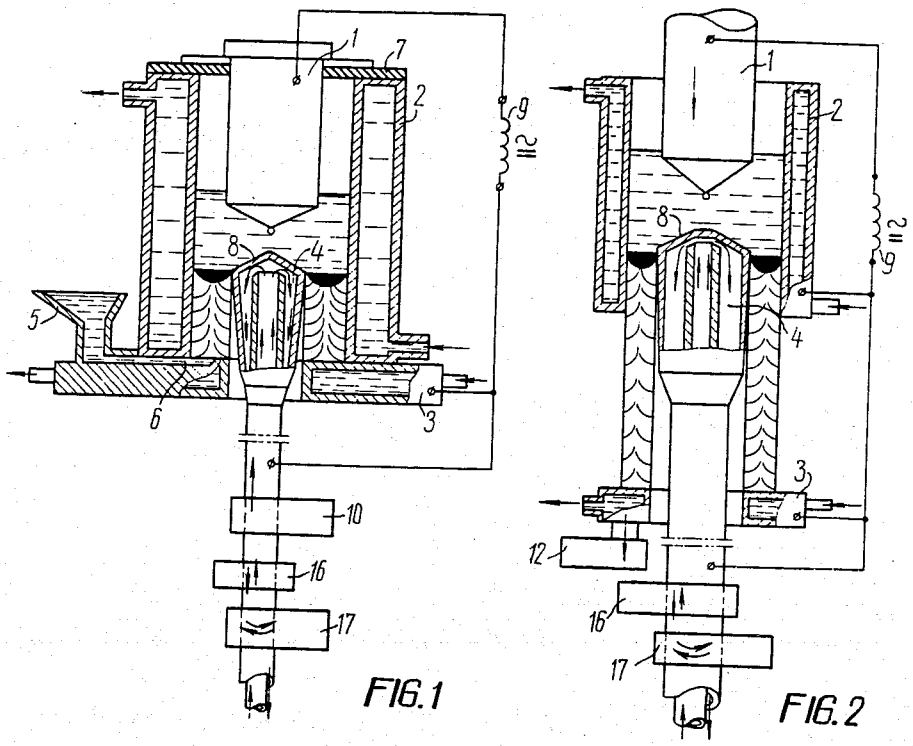
FIG. 1 represents a device for obtaining hollow ingots by the electroslag remelting of a consumable electrode, which, according to the invention, is provided with a mechanism for moving a core in relation to a stationary mold and bottom plate.
FIG. 2 shows the same device complete with a mechanism for moving a bottom plate together with an ingot in relation to the core and stationary mold.

The remelting of the consumable electrode 1 (FIGS. 1, 2, 3) is carried out in a cooled mold 2. Provided under the mold is a cooled bottom plate 3 provided with an opening.

The internal surface of the hollow ingot being builtup is formed by means of a cooled rod 4 passing through the opening in the bottom plate. A bottom-pouring device 5 and a runner 6 are provided in order to supply the molten slag into the mold. Slag may be also top-poured into the mold. During the remelting process, a consumable electrode 1 is fed into the slag bath. The process of remelting a hollow ingot, however, may be also carried into effect with the consumable electrode being stationary. In this case, the electrode is secured on the upper edge of the mold, being insulated therefrom by means of a packing 7, whereas the cross-sectional area of the electrode will have to be selected equal or approximating that of the hollow ingot being made in the remelting process.

Before starting the remelting process, the rod 4 is inserted in the opening of the bottom plate in such a manner that the upper end face thereof be projected over the bottom plate and will form together with the mold an annular gap. The gap between the core and opening in the bottom plate must be as small as possible in order to prevent slag from flowing out from the mold at the beginning of the remelting process. The molten slag is poured into the mold, thus forming the slag bath. Then voltage from an alternating or direct-current source such as the power source 9 is applied to the electrode 1, the bottom plate 3 and the core 4.

With the voltage applied, as soon as the lower end of the consumable electrode and the molten slag bath are in contact, current starts to flow and melting of the consumable electrode begins. The melting of the consumable electrode results in molten metal, which gets into the annular gap, thus flowing around the upper end face 8 of the cooled core 4 projecting into the slag bath. This brings about the formation of a molten annular metal bath, from which a hollow ingot solidifes. In the remelting process, the upper end face of the cooled core will have to be maintained in the slag bath so as to prevent a solidifed crust from being formed thereon, which may interfere with the further proceeding of the remelting process.

For constantly maintaining the upper end face 8 of the core in the slag bath in the process of building up the hollow ingot, there is carried into effect the mutual movement of the mold, core and bottom plate together with the ingot being built-up and secured thereon, at a speed near that of rising of the slag bath.

Figure 3:
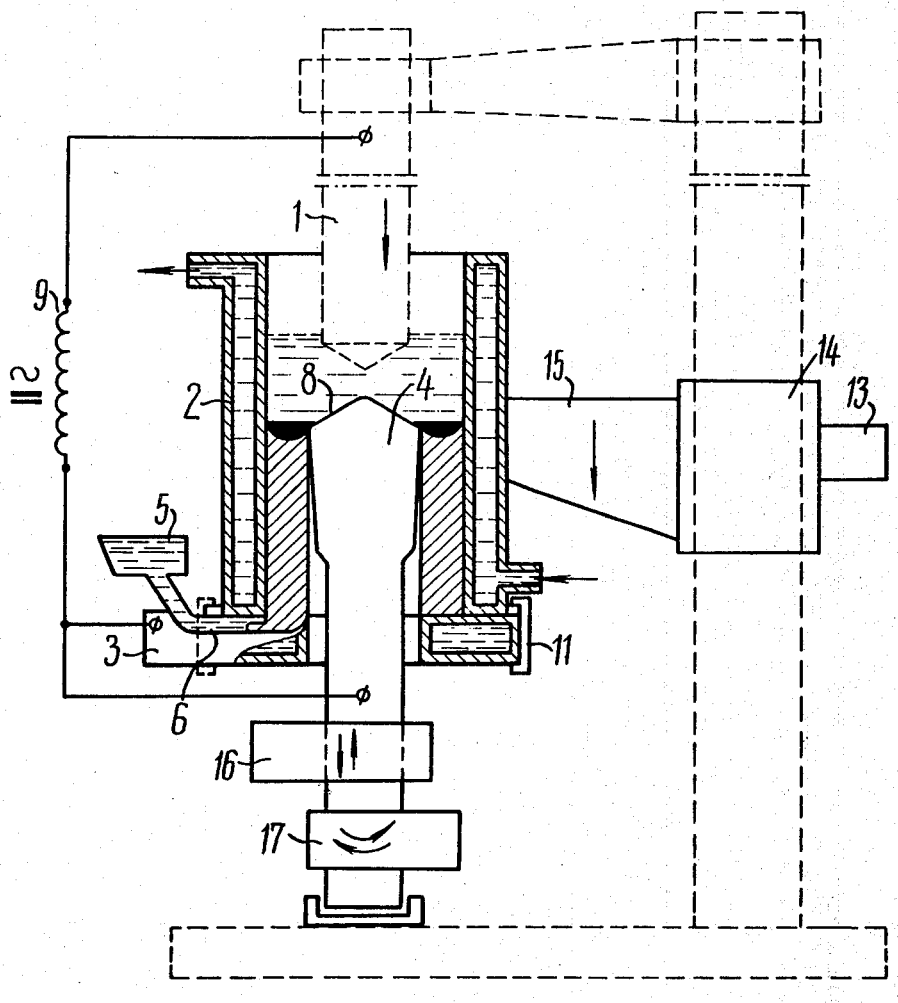
FIG. 3 represents the same device complete with a mechanism for moving the mold together with the bottom plate and the ingot being built-up downwardly in relation to the core.

Motion of the core upwardly in relatin relation the stationary mold and bottom plate is carried into effect by means of a mechanism 10 (FIG. 1) provided on the rod of the core. In this case, the mold is stationary and is secured on the bottom plate, for example, by means of a screw clamp 11 (FIG. 3). Pick-ups (which are not shown in the drawing) are employed for controlling the position of the upper end of the core in the slag bath.

In conformity with the second embodiment of the invention, the internal cavity of the ingot is formed by moving the bottom plate together with the ingot in relation to the core and stationary mold by having recourse to a mechanism 12 (FIG. 2) connected to the bottom plate (for example, a screw pair).

FIG. 3 represents a device for casting a hollow ingot, in which, in the process of its remelting, the mold is moved in relation to the core together with the bottom plate and the ingot secured thereon. A mechanism 13 (FIG. 3) is connected with the mold through a support 14 and a bracket 15. In this case, the mold is secured on the bottom plate by means, for example, of screw clamps 11.

To improve the internal surface of the hollow ingot the core may be connected to a mechanism 16, imparting thereto rocking motion in the longitudinal direction and/or to a mechanism 17 imparting thereto reciprocal rotary motion.

As soon as the hollow ingot of the required length is made, the voltage is disconnected and the consumable electrode is removed. In all the above-mentioned embodiments of the device, disconnection of voltage is followed by the mutual motion of the mold, core and bottom plate together with the ingot secured thereon until the core completely emerges from the ingot's cavity so as to prevent the core from being clamped in the ingot during its shrinkage in cooling.

Thereafter, the core is disengaged from its rod, and the hollow ingot is extracted.

The proposed method and device for effecting same permit hollow ingots to be produced without internal, nor external defects, from a high-quality, electroslag metal. Application of this method and device for effecting same permit elimination of expensive operations, such as drilling and piercing, when manufacturing pipe stock from cores of solid section which is of a special importance when manufacturing pipe stock from metals and alloys that are difficult to work.

The invention may be embodied in other specific forms without departing from the scope, spirit, or essential characteristics thereof. Present embodiments are, therefore, to be considered in all respects as illustrative and not restrictive, the scope and spirit of the invention being indicated by the appended claims rather than by the foregoing description and all changes which come within the meaning and range of equivalency of the claims are, therefore, intended to be embraced therein.

What is claimed and desired to be secured by Letters Patent is:

1. A device for making hollow metal ingots by electroslag remelting of consumable electrode means, comprising: consumable electrode means; a cooled mold for formation of an ingot being built-up and wherein a molten slag bath is created; a cooled core terminating in an upper free end disposed in the said mold and intended for formation of the internal cavity in the ingot being built-up; means connected to the lower end of said core and thereby providing a mounting for said core; a bottom plate retaining the ingot being built-up; a means for effecting relative motion between said core and said bottom plate; and a current source, with connections from one side of said current source to both said bottom plate and said core, and from the other side of said current source to said consumable electrode means.

2. A device as claimed in Claim 1, which is provided with means for imparting to the core reciprocatory motion in the longitudinal direction.

3. A device as claimed in Claim 1, which is provided with means for imparting to the core reciprocal rotary motion.

4. A device as defined in claim 1, wherein means fix said mold and said bottom plate relative to each other during remelting.

5. A device as defined in claim 1, including means for effecting relative motion between said mold and said bottom plate.

6. A device as defined in claim 1, wherein said bottom plate has an opening vertically therethrough and said core is mounted to extend up through said opening.

7. A device for making hollow metal ingots by electroslag remelting of consumable electrode means comprising: a cooled mold for formation of an ingot, said mold being adapted to contain a molten slag bath; a cooled core disposed in said mold for providing an internal cavity in the ingot to be formed in said mold; a bottom plate for retaining said ingot; means for effecting relative motion between said bottom plate and said core including means for imparting to said core reciprocatory motion in the longitudinal direction; a current source; and electrical lead means connecting one side of said current source to both said core and said bottom plate, and connecting the other side of said current source to said consumable electrode means.

8. A device for making hollow metal ingots by electroslag remelting of consumable electrode means comprising: a cooled mold for formation of an ingot, said mold being adapted to contain a molten slag bath; a cooled core disposed in said mold for providing an internal cavity in the ingot to be formed in said mold; a bottom plate for retaining said ingot; means for effecting relative motion between said bottom plate and said core including means for imparting to said core reciprocal rotary motion; a current source; and electrical lead means connecting one side of said current source to both said core and said bottom plate, and connecting the other side of said current source to said consumable electrode means.

9. A device as defined in claim 8, including means for effecting relative motion between said mold and said bottom plate.

10. A device for making hollow metal ingots by electroslag remelting of consumable electrode means comprising: a cooled mold for formation of an ingot, said mold being adapted to contain a molten slag bath; a cooled core disposed in said mold for providing an internal cavity in the ingot to be formed in said mold; a bottom plate for retaining said ingot; means fixing said mold and said bottom plate relative to each other during remelting; means for effecting relative motion between said bottom plate and said core; a current source; and electrical lead means connecting one side of said current source to both said core and said bottom plate, and connecting the other side of said current source to said consumable electrode means.

11. A device for making hollow metal ingots by electroslag remelting of consumable electrode means comprising: a cooled mold for formation of an ingot, said mold being adapted to contain a molten slag bath; a cooled core disposed in said mold for providing an internal cavity in the ingot to be formed in said mold; a bottom plate for retaining said ingot; said bottom plate having an opening vertically therethrough; means mounting said core to extend up through said opening; means for effecting relative motion between said bottom plate and said core; a current source; and electrical lead means connecting one side of said current source to both said core and said bottom plate, and connecting the other side of said current source to said consumable electrode means.

* * * * *